US010801493B2

(12) United States Patent
Howseman, Jr.

(10) Patent No.: US 10,801,493 B2
(45) Date of Patent: Oct. 13, 2020

(54) POSITIVE DISPLACEMENT RECIPROCATING PUMP ASSEMBLY FOR DISPENSING PREDETERMINEDLY PRECISE AMOUNTS OF FLUID DURING BOTH THE UP AND DOWN STROKES OF THE PUMP PISTON

(71) Applicant: William E. Howseman, Jr., Camarillo, CA (US)

(72) Inventor: William E. Howseman, Jr., Camarillo, CA (US)

( * ) Notice: Subject to any disclaimer, the term of this patent is extended or adjusted under 35 U.S.C. 154(b) by 346 days.

(21) Appl. No.: 15/841,650

(22) Filed: Dec. 14, 2017

(65) Prior Publication Data

US 2019/0186486 A1 Jun. 20, 2019

(51) Int. Cl.

| | |
|---|---|
| ***F04B 53/14*** | (2006.01) |
| ***F04B 13/00*** | (2006.01) |
| ***F04B 53/02*** | (2006.01) |
| *F04B 53/16* | (2006.01) |

(52) U.S. Cl.

CPC ..... *F04B 53/144* (2013.01); *F04B 13/00* (2013.01); *F04B 53/02* (2013.01); *F04B 53/143* (2013.01); *F04B 53/16* (2013.01)

(58) Field of Classification Search

CPC ..... F04B 53/144; F04B 13/00; F04B 53/02; F04B 53/143

USPC ..... 92/165 R

See application file for complete search history.

(56) References Cited

U.S. PATENT DOCUMENTS

| | | | |
|---|---|---|---|
| 171,592 | A | 12/1875 | Van Doren |
| 530,350 | A | 12/1894 | Rosenkranz |
| 1,263,201 | A | 4/1918 | Brown |
| 1,616,201 | A | 2/1927 | Shearer |
| 2,895,421 | A | 7/1959 | Peeps |
| 2,954,737 | A | 10/1960 | Hoover |
| 3,366,066 | A | 1/1968 | Levey |
| 3,583,837 | A | 6/1971 | Rolsten |

(Continued)

*Primary Examiner* — Abiy Teka

(74) *Attorney, Agent, or Firm* — Law Offices of Steven W. Weinrieb

(57) ABSTRACT

The present invention comprises a new and improved positive displacement reciprocating pump wherein the pump comprises a pump rod assembly which comprises three different regions having three different external diameter dimensions or three different external diametrical extents wherein the first uppermost region is provided with an external diameter or diametrical extent of 0.500 inches which has a surface area of 0.1964 in$^2$, the second intermediate one of the three regions is provided with an external diameter or diametrical extent of 0.525 inches which has a surface area of 0.2166 in$^2$, and the third lowermost one of the three regions is provided with an external diameter or diametrical extent of 0.474 inches which has a surface area of 0.1762 in$^2$. The differences between the external diameters or external diametrical extents of the three regions enable the positive displacement reciprocating pump to pump or dispense the same particular precise amount of fluid out from the pump during both the UP and DOWN strokes of the pump piston rod assembly. The piston rod assembly may comprise three piston rod sections or, alternatively, two piston rod sections and an intermediate rod seal or packing region movable along with the pump piston rod assembly.

13 Claims, 7 Drawing Sheets

(56) References Cited

U.S. PATENT DOCUMENTS 3,635,125 A 1/1972 Rosen et al.
3,827,339 A 8/1974 Rosen et al.
4,030,857 A 6/1977 Smith, Jr.
4,346,849 A 8/1982 Rood
4,509,903 A 4/1985 Fram
5,067,882 A * 11/1991 DeVries ..... F04B 5/02 137/528
5,238,372 A * 8/1993 Morris ..... F01L 25/06 417/393
5,346,037 A * 9/1994 Flaig ..... F04B 53/164 184/24
5,435,697 A 7/1995 Guebeli et al.
5,456,583 A * 10/1995 Handzel ..... F04B 53/1002 417/454
5,558,506 A * 9/1996 Simmons ..... F01B 1/00 137/625.69
5,647,737 A 7/1997 Gardner et al.
5,671,656 A * 9/1997 Cyphers ..... F04B 15/00 417/DIG. 1
5,984,646 A 11/1999 Renfro et al.
6,155,806 A * 12/2000 Andel ..... F04B 53/1007 417/403
6,212,997 B1 * 4/2001 McCollough ..... F04B 53/144 417/554
6,558,141 B2 5/2003 Vonalt et al.
6,575,019 B1 * 6/2003 Larson ..... G01N 11/04 73/54.04
6,619,316 B2 9/2003 Wiechers et al.
7,296,981 B2 11/2007 Strong
7,384,249 B2 * 6/2008 Romanin ..... G01F 11/04 417/404
7,980,197 B2 * 7/2011 Prentice ..... B05C 5/0225 118/688
9,260,234 B2 * 2/2016 Ikushima ..... B05C 11/1034
10,253,771 B2 * 4/2019 Carey ..... F04B 53/1007
2007/0128053 A1 * 6/2007 Stamper ..... F04B 53/22 417/397
2007/0253847 A1 * 11/2007 Stamper ..... F04B 5/02 417/437
2010/0206549 A1 * 8/2010 Dowling ..... E21B 43/126 166/105
2010/0209265 A1 * 8/2010 Dowling ..... F04B 23/08 417/404
2012/0114510 A1 * 5/2012 Brown ..... E21B 43/127 417/399
2014/0015202 A1 * 1/2014 Chacko ..... F04B 1/0408 277/500
2014/0203625 A1 * 7/2014 Starr ..... B60T 11/236 303/6.01
2015/0337821 A1 * 11/2015 Yang ..... F04B 33/005 417/259
2016/0102536 A1 * 4/2016 Knoeller ..... F04B 53/14 417/53
2016/0151798 A1 * 6/2016 Van Keulen ..... B05B 15/55 239/407
2016/0186742 A1 * 6/2016 Bhat ..... F02M 59/442 92/172
2017/0248136 A1 * 8/2017 Schlenker ..... F04B 19/22
2019/0316582 A1 * 10/2019 Wu ..... F04B 53/12

* cited by examiner

POSITIVE DISPLACEMENT RECIPROCATING PUMP ASSEMBLY FOR DISPENSING PREDETERMINEDLY PRECISE AMOUNTS OF FLUID DURING BOTH THE UP AND DOWN STROKES OF THE PUMP PISTON

FIELD OF THE INVENTION

The present invention relates generally to pumps, and more particularly to a new and improved positive displacement reciprocating pump assembly which is uniquely capable of dispensing a predeterminedly small precise amount of fluid during both the UP and DOWN strokes of the pump piston rod assembly.

BACKGROUND OF THE INVENTION

Reciprocating pumps are of course well known in the art for dispensing a variety of different fluids. Examples of known reciprocating dispensing pumps can be appreciated as a result of reference being made to U.S. Pat. No. 7,296,981 which issued to Strong on Nov. 20, 2007; U.S. Pat. No. 6,619,316 which issued to Wiechers et al. on Sep. 16, 2003; U.S. Pat. No. 6,558,141 which issued to Vonalt et al. on May 6, 2003; U.S. Pat. No. 5,984,646 which issued to Renfro et al. on Nov. 16, 1999; U.S. Pat. No. 5,671,656 which issued to Cyphers et al. on Sep. 30, 1997; U.S. Pat. No. 5,647,737 which issued to Gardner et al. on Jul. 15, 1997; U.S. Pat. No. 5,435,697 which issued to Guebeli et al. on Jul. 25, 1995; U.S. Pat. No. 4,509,903 which issued to Fram on Apr. 9, 1985; U.S. Pat. No. 4,386,849 which issued to Rood on Aug. 31, 1982; U.S. Pat. No. 4,030,857 which issued to Smith, Jr. on Jun. 21, 1977; U.S. Pat. No. 3,827,339 which issued to Rosen et al. on Aug. 6, 1974; U.S. Pat. No. 3,635,125 which issued to Rosen et al. on Jan. 18, 1972; U.S. Pat. No. 3,583,837 which issued to Rolsten on Jun. 8, 1971; U.S. Pat. No. 3,366,066 which issued to Levey on Jan. 30, 1968; U.S. Pat. No. 2,954,737 which issued to Hoover on Oct. 4, 1960; U.S. Pat. No. 2,895,421 which issued to Peeps on Jul. 21, 1959; U.S. Pat. No. 1,616,201 which issued to Shearer on February, 1927; U.S. Pat. No. 1,263,201 which issued to Brown on Apr. 16, 1918; U.S. Pat. No. 530,350 which issued to Rosenkranz on Dec. 4, 1894; and U.S. Pat. No. 171,592 which issued to Van Doren on Dec. 28, 1875.

In certain industries, it is often desirable to dispense a composition which may be fabricated from several individual and specific ingredients or constituents. More particularly, it is often the case that in order to achieve specifically desirable objectives, the particular ingredients comprising the composition must have critically important volumetric percentages in order to provide the resulting composition with particularly desirable characteristics such as, for example, strength, softness or hardness, durability, and the like. While the pumps disclosed within the aforenoted prior art patent documents are certainly capable of pumping fluids as intended, such conventional prior art pumps are not in fact capable of pumping and dispensing particular fluids in consistently precise volumetric amounts. In addition, the aforenoted conventional pumps comprise complex valving and fluid flow circuitry in order to achieve their pumping and dispensing functions. Still further, in order to dispense a predetermined amount of fluid which will cover a predeterminedly small area, conventional piston pumps have utilized piston rods which have extremely small diametrical extents. Accordingly, the piston rods are not sufficiently strong or robust enough to withstand thousands of reciprocating movements which are characteristic of such reciprocating pump piston rods throughout their normal service life. Therefore, the pump piston rods need to be replaced more frequently than desirable which is expensive not only in terms of the cost of each pump piston rod, but in addition, the cost of the necessary maintenance procedures and the loss of valuable production time due to the fact that a particular pump is off-line or suffering downtime while the maintenance procedures are being performed.

A need therefore exists in the art for a new and improved positive displacement reciprocating pump assembly. An additional need exists in the art for a new and improved positive displacement reciprocating pump assembly which is relative simple in structure. A further need exists in the art for a new and improved positive displacement reciprocating pump assembly which is relatively simple in structure and which can pump and dispense precise amounts of fluid both during the UP and DOWN working strokes of the pump piston rod assembly. A still further need exists in the art for a new and improved positive displacement reciprocating pump assembly which utilizes pump piston rods which are relatively large in diametrical extent relative to the amount of fluid dispensed during each UP and DOWN stroke of the pump piston such that the pump piston rods are strong and robust so as to be capable of withstanding very high pressures as well as thousands of fluid dispensing cycles.

OVERALL OBJECTIVES OF THE INVENTION

An overall objective of the present invention is to provide a new and improved positive displacement reciprocating pump assembly. Another overall objective of the present invention is to provide a new and improved positive displacement reciprocating pump assembly which is relatively simple in structure. A further overall objective of the present invention is to provide a new and improved positive displacement reciprocating pump assembly which is relatively simple in structure and which can pump and dispense precise amounts of fluid both during the UP and DOWN strokes of the pump piston rod assembly. A still further overall objective of the present invention is to provide a new and improved positive displacement reciprocating pump assembly which utilizes pump piston rods which are relatively large in diametrical extent relative to the amount of fluid dispensed during each UP and DOWN stroke of the pump piston such that the pump piston rods are strong and robust so as to be capable of withstanding very high pressures as well as thousands of fluid dispensing cycles.

SUMMARY OF THE INVENTION

The foregoing and other objectives are achieved in accordance with the teachings and principles of the present invention through the provision of a first embodiment of a new and improved positive displacement reciprocating pump assembly wherein the pump piston rod assembly, disposed internally within the pump assembly housing, actually comprises three coaxially arranged piston rods having three different external diameter dimensions or three different external diametrical extents wherein the three piston rods are connected together such that the three piston rods move together as a single pump piston rod assembly in opposite axial directions, during UP and DOWN strokes, internally within the pump assembly housing. More particularly, the uppermost one of the three piston rods is provided with an external diameter or diametrical extent of 0.500 inches which has a surface area of 0.1964 $in^2$, the intermediate one of the three piston rods is provided with an external diameter or diametrical extent of 0.525 inches which has a surface area of 0.2166 $in^2$, and the lowermost one of the three piston rods is provided with an external diameter or diametrical extent of 0.474 inches which has a surface area of 0.1762 $in^2$. As will become more apparent hereinafter, these differences between the external diameters or external diametrical extents of the three piston rods, and their surface areas, enable the reciprocating pump to pump or dispense the same particular precise amount of fluid out from the pump during both the UP and DOWN pumping strokes of the pump piston rod assembly.

In accordance with a second embodiment of the new and improved reciprocating pump assembly as constructed in accordance with the principles and teachings of the present invention, the positive displacement reciprocating pump assembly need only comprise two piston rod sections, however, there will nevertheless effectively be three different external diameter regions as is characteristic of the first embodiment of the reciprocating pump assembly whereby similar pump outputs are likewise able to be achieved.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
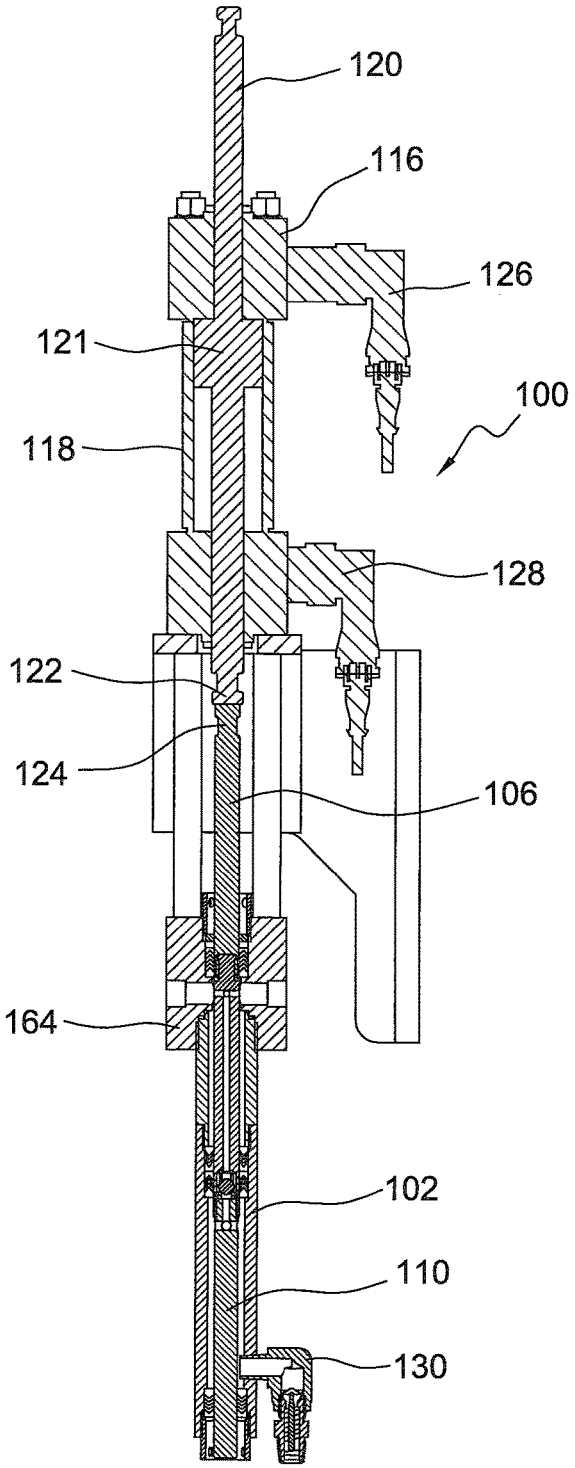
FIG. 1 is a longitudinal cross-sectional view of a first embodiment of a new and improved positive displacement reciprocating pump assembly constructed in accordance with the principles and teachings of the present invention wherein the piston rod assembly is disclosed as being disposed at its raised or UP position.
Figure 2:
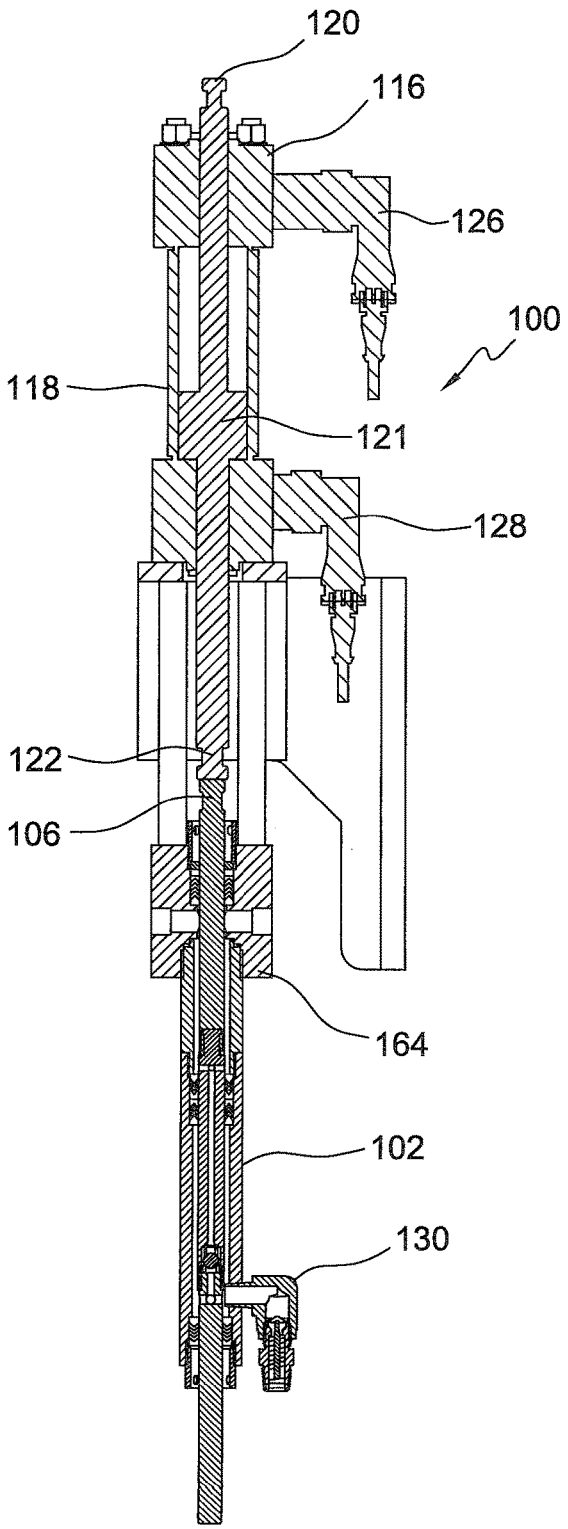
FIG. 2 is a longitudinal cross-sectional view of the new and improved reciprocating pump assembly, as shown within FIG. 1, wherein, however, the piston rod assembly is disclosed as being disposed at it the lowered or DOWN position.

Referring now to the drawings, and more particularly to FIGS. 1-6 thereof, the description will first provide an overall general description of the first embodiment of the new and improved positive displacement reciprocating pump assembly of the present invention, to be followed by a description of the operation of the pump assembly during both the UP and DOWN strokes of the working piston so as to clearly disclose the unique features of the new and improved pump assembly of the present invention in providing predeterminedly small but accurate amounts of fluid output. Accordingly, with reference to the noted drawings, it is initially seen that the new and improved reciprocating pump assembly of the present invention is generally indicated by the reference character 100. More particularly, it is seen that the new and improved reciprocating pump assembly 100 comprises a pump piston rod housing 102 within which the reciprocating pump piston rod assembly 104 is vertically movable between its raised or UP position, as disclosed within FIGS. 1 and 4, and its lowered or DOWN position as disclosed within FIGS. 2 and 5.

Figure 3:
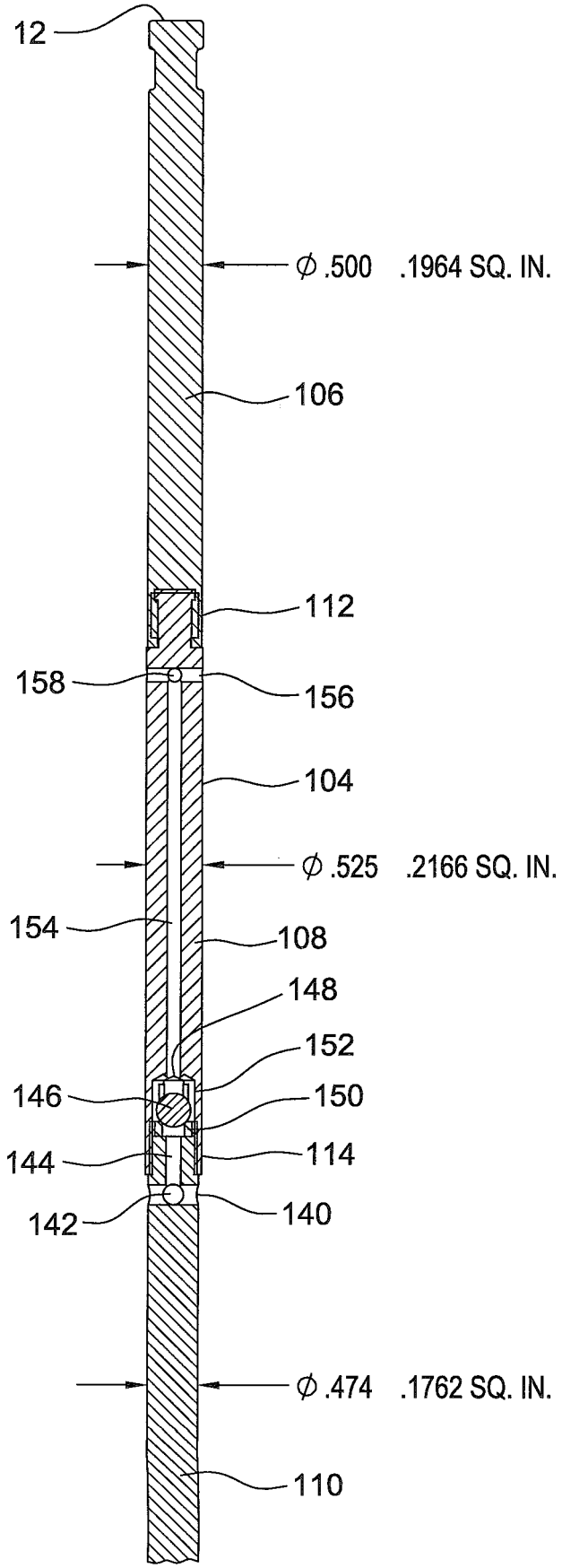
FIG. 3 is an enlarged longitudinal cross-sectional view of the piston rod assembly, as disclosed within FIG. 1, disclosing the three coaxially arranged piston rods connected together in an end-to-end manner so as to effectively define the single piston rod assembly of the reciprocating pump.

As can best be appreciated from FIG. 3, it is seen that the pump piston rod assembly 104 actually comprises three pump piston rod sections 106, 108,110 which are coaxially disposed with respect to each other and which are vertically disposed atop one another in an end-to-end manner. More particularly, it is seen that the first uppermost pump piston rod section 106 comprises a piston rod which has an external diameter or an external diametrical extent of 0.500 inches (0.500 in) and which provides a surface area of 0.1964 square inches (0.1964 $in^2$). The lower end portion of the first uppermost pump piston rod section 106 is adapted to be connected to the upper end portion of the second intermediate pump piston rod section 108 by any suitable means such as, for example, cooperative threaded connections 112. The second intermediate pump piston rod section 108 comprises a piston rod which has an external diameter or an external diametrical extent of 0.525 inches (0.525 in) and which provides a surface area of 0.2166 square inches (0.2166 $in^2$). The lower end portion of the second intermediate pump piston rod section 108 is adapted to be connected to the upper end portion of the third lowermost pump piston rod section 110 by any suitable means such as, for example, cooperative threaded connections 114. Still further, the third lowermost pump piston rod section 110 comprises a piston rod which has an external diameter or an external diametrical extent of 0.474 inches (0.474 in) and which provides a surface area of 0.1762 square inches (0.1762 $in^2$). Lastly, in order to actuate the pump piston rod assembly 104, and thereby move the same through its UP and DOWN reciprocal movements, it is seen, as can best be appreciated from FIGS. 1 and 2, that the upper end portion of the first uppermost pump piston rod section 106 is operatively connected to a fluidic actuator, which may be, for example, a hydraulic drive motor assembly 116. More particularly, the hydraulic motor drive assembly 116 is seen to comprise a housing 118 within which there is reciprocally disposed an actuator piston 120. The lower end portion 122 of the actuator piston 120 is adapted to be fixedly connected to the upper end portion 124 of the first pump piston rod 106, and a pair of input/output hydraulic connectors 126,128 are fluidicallly connected to the hydraulic motor drive housing 118, by means of fluid control circuits disposed internally within the hydraulic motor drive housing 118 and therefore not illustrated but well known in the art, so as to alternatively provide hydraulic fluid to internal regions of the hydraulic motor drive housing 118 both above and below opposite end surface portions of an actuator piston head 121 in order to reciprocally drive the actuator piston 120 upwardly and downwardly so as to in turn move the pump piston rod assembly 104 between its raised or UP position and its lowered or DOWN position.

Figure 4:
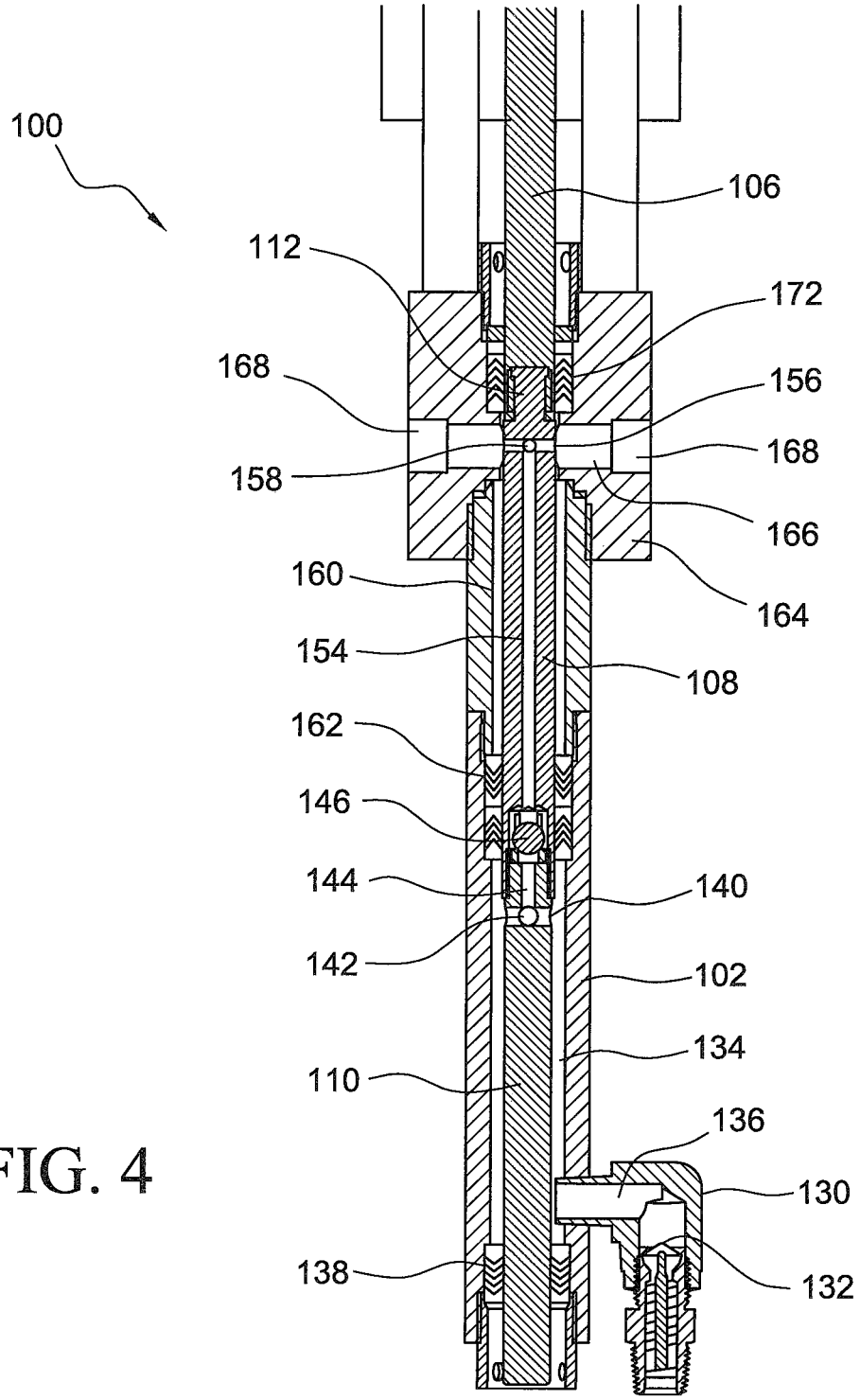
FIG. 4 is an enlarged longitudinal cross-sectional view of a section of the reciprocating pump assembly as disclosed within FIG. 1 so as to more clearly illustrate the fluid flow of the fluid into the reciprocating pump assembly when the piston rod assembly is moved to its raised or UP position.

With reference now being made, for example, to FIG. 4, additional structure comprising the new and improved pump assembly 100 of the present invention will now be disclosed in conjunction with the pump assembly 100 when the pump piston rod assembly 104 is disposed at its raised or UP position. More particularly, it is seen that a fluid intake valve assembly 130 is operatively connected to the lower end portion of the pump piston rod housing 102, and that a first lower check valve 132, which may be a ball valve, poppet valve, or the like, is disposed within the valve assembly 130. In addition, a first annular chamber 134 is defined between the external peripheral surface of the third lowermost piston rod 110 and the interior peripheral surface of the pump piston rod housing 102. Still further, it is to be appreciated that the fluid intake valve assembly 130 is fluidically connected to the annular chamber 134 by means of a fluid conduit 136 which extends from the first lower check valve 132 to the first annular chamber 134. Beneath the axial location at which the fluid conduit 136 is fluidically connected to the first annular chamber 134, there is fixedly provided within a lower portion of the pump piston rod housing 102 a first lower set of annular rod seals or packing material 138 such that the incoming fluid cannot leak out from the lower end portion of the pump piston rod housing 102. As can also be understood from FIG. 3, it is further seen, continuing axially upwardly from the third lowermost piston rod section 110 toward the upper end portion of the third lowermost piston rod section 110 that is fixedly connected to the second intermediate piston rod 108 within the vicinity of the connection junction 114, the upper end portion of the third lowermost piston rod section 110 is provided with a first pair of orthogonally oriented through-bores 140,142.

Furthermore, a vertically oriented, axially located fluid conduit 144 extends upwardly from the junction of the pair of orthogonally oriented through-bores 140,142 to a second check valve 146 which may be, for example, a ball check valve which moves between an upper ball stop 148 and a lower valve seat 150 as will be more fully described hereinafter. The ball check valve 146 is preferably disposed within a ball cage such that multiple fluid passageways 152 are effectively defined above and around the ball check valve 146. When the ball check valve 146 is seated upon the lower valve seat 150, fluid flow is obviously blocked, however, when the ball check valve 146 is moved toward and engaged with the upper ball stop 148, fluid can flow from the pair of orthogonally oriented through-bores 140,142, upwardly through the vertical fluid passageway 144, and into the multiple fluid passageways 152. It is also seen that the upper terminal ends of the multiple fluid passageways 152 effectively bypass the upper ball stop 148 so as to be fluidically connected to a vertically oriented axially extending fluid passageway 154 that is defined within the second intermediate pump piston rod section 108. As was the case with the provision of the first pair of orthogonally oriented through-bores 140, 142 defined within the upper end portion of the third lowermost pump piston rod section 110, a second pair of orthogonally oriented through-bores 156,158 are defined within the upper end portion of the second intermediate pump piston rod section 108 so as to be fluidically connected to the vertically oriented, axial fluid passageway 154 defined within the second intermediate pump piston rod section 108.

Continuing still further, and with reference being made again to FIG. 4, it is further noted that, as was the case with the external peripheral surface of the third lowermost pump piston rod section 110 defining the first annular chamber 134 with respect to the internal peripheral surface of the pump piston rod housing 102, the external peripheral surface of the second intermediate pump piston rod section 108 likewise defines a second annular chamber 160 with respect to the internal peripheral surface of the pump piston rod housing 102, and a second intermediate set of annular rod seals or packing material 162 is fixedly disposed within the lowermost end portion of the second annular chamber 160 within the vicinity of the piston rod connection junction 114 defined between the lower end portion of the second intermediate pump piston rod section 108 and the upper end portion of the third lowermost pump piston rod section 110. It is further seen that a fluid outlet junction box 164 is fixedly secured to the upper end of the pump piston rod housing 102, and while a horizontally oriented through-bore 166 is disclosed as being defined within the fluid outlet junction box 164 so as to permit the fluid to be dispensed outwardly through a pair of fluid outlets 168, however, in use, only one of the two fluid outlets 168,168 is actually used while a plug, not illustrated, is disposed within the other one of the two fluid outlets 168,168. It is also to be appreciated that the second annular chamber 160 is always fluidically connected to the horizontally oriented through-bore 166 and the fluid outlets 168,168 by means of an axial extension 170 of the second annular chamber 160 which is defined within the fluid outlet junction box 164 as can best be seen in FIG. 6. It is noted that a third upper set of annular rod seals or packing material 172 is fixedly disposed within the fluid outlet junction box 164 at an axial position above the cross bore or through-bore 166 so as to prevent undesirable leakage of fluid from the fluid outlet junction box 164. It is also to be noted throughout the upward and downward movements of the pump piston rod assembly 104, the first lower set of orthogonally oriented cross bores or through-bores 140,142 always remain at axial positions between the first lower set of annular rod seals or packing material 138 and the second intermediate set of annular rod seals or packing material 162, while in a similar manner, the second upper set of orthogonally oriented cross bores or through-bores 156,158 always remain at axial positions between the second intermediate set of annular rod seals or packing material 162 and the third upper set of annular rod seals or packing material 172.

Having described substantially all of the main operative components of the new and improved reciprocating pump assembly 100, a brief description of the operation of the positive displacement reciprocating pump assembly 100, during both of its movements toward its raised or UP position and its lowered or DOWN position, will now be described. It has been noted earlier that the new and improved positive displacement reciprocating pump has been developed so as to in fact be capable of dispensing small, precise amounts of fluid such as, for example, material comprising 0.0202 square inches (0.0202 $in^2$). As the pump piston rod assembly, comprising the three pump piston rods 106,108, 110, is moved upwardly from the lowered or DOWN position, as disclosed within FIG. 5, to the raised or UP position, as disclosed within FIG. 4, relatively low pressure incoming fluid will enter the pump assembly 100 through means of the fluid intake valve assembly 130 and flow past the first lower check valve 132. Such fluid will therefore enter the first annular chamber 134, however, since the first lower annular rod seals or packing material 138 is disposed within the lower end of the first annular chamber 134, while the second intermediate annular rod seal or packing material 162 is disposed within the vicinity of the connector junction 114 as defined between the second intermediate pump piston rod 108 and the third lowermost pump piston rod 110, the relatively low pressure incoming fluid can only act upon the underside of the ball check valve 146.

At the same time, however, as the pump piston rod assembly 104 is moving upwardly, and remembering that the external diameter or external diametrical extent of the second intermediate pump piston 108 is 0.525 inches (0.525 in) and has a surface area of 0.2166 square inches (0.2166 $in^2$), while the external diameter or external diametrical extent of the first uppermost pump section 106 is 0.500 inches (0.500 in) and has a surface area of 0.1964 square inches (0.1964 $in^2$), the upward movement of the pump piston rod assembly 104 causes fluid, disposed within the second annular chamber 160 from a previous operational cycle and now under relatively high pressure due to the upward movement of the pump piston rod assembly 104 within the pump piston rod housing 102, to move upwardly through the second annular chamber 160 such that an output deposit of 0.0202 square inches (0.0202 $in^2$), which is derived by subtracting the surface area of 0.1964 square inches (0.1964 $in^2$) of the first uppermost pump section 106 from the surface area of 0.2166 square inches (0.2166 $in^2$) characteristic of the second intermediate pump section 108, is caused to flow upwardly through the second annular chamber 160, through the axial extension 170 of the second annular chamber 160 which is defined within the fluid outlet junction box 164, and out through a particular one of the fluid outlets 168. At the same time, it is to be additionally appreciated that the aforenoted relatively high pressure fluid is also fluidically connected to the central or axial fluid passageway 154 defined within the intermediate pump piston rod 108, through means of the second pair of orthogonally oriented through-bores 156,158 which are defined within the upper end portion of the second intermediate pump piston rod section 108. Accordingly, the relatively high-pressure fluid acts upon the upper side of the ball check valve 146 in order to maintain such in its closed position as a result of being seated upon its lower valve seat 150.

Figure 5:
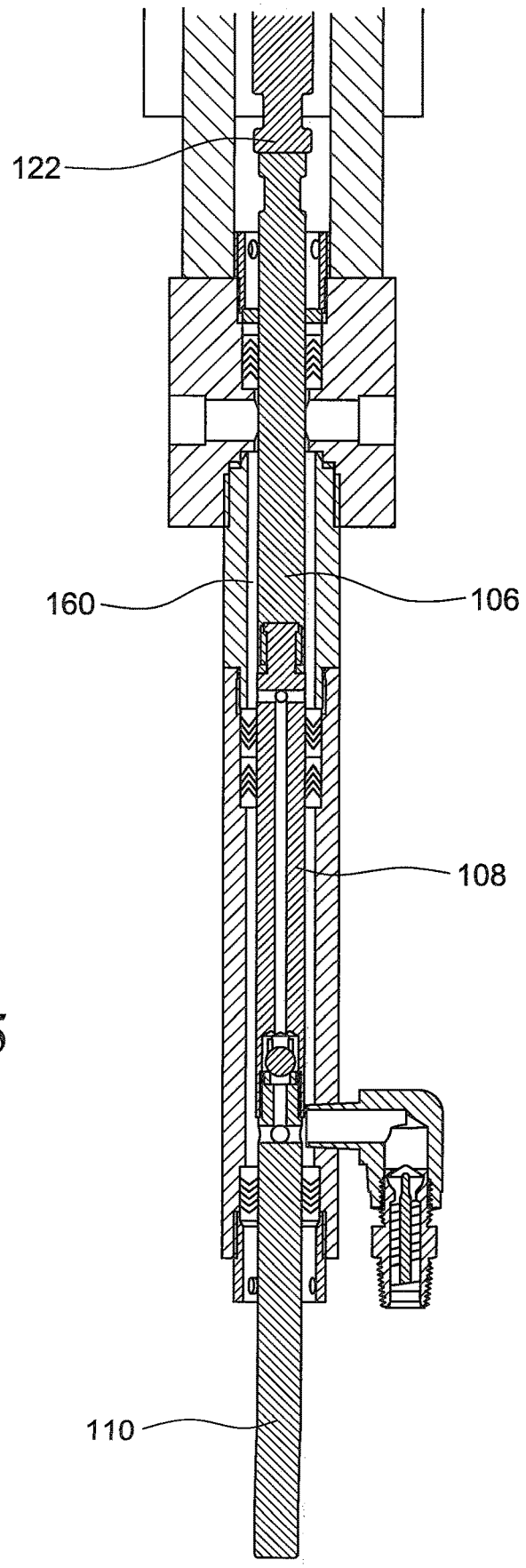
FIG. 5 is an enlarged longitudinal cross-sectional view of a section of the reciprocating pump as disclosed within FIG. 2 so as to more clearly illustrate the fluid flow of the fluid into the reciprocating pump assembly when the piston rod assembly is moved to its lowered or DOWN position.
Figure 6:
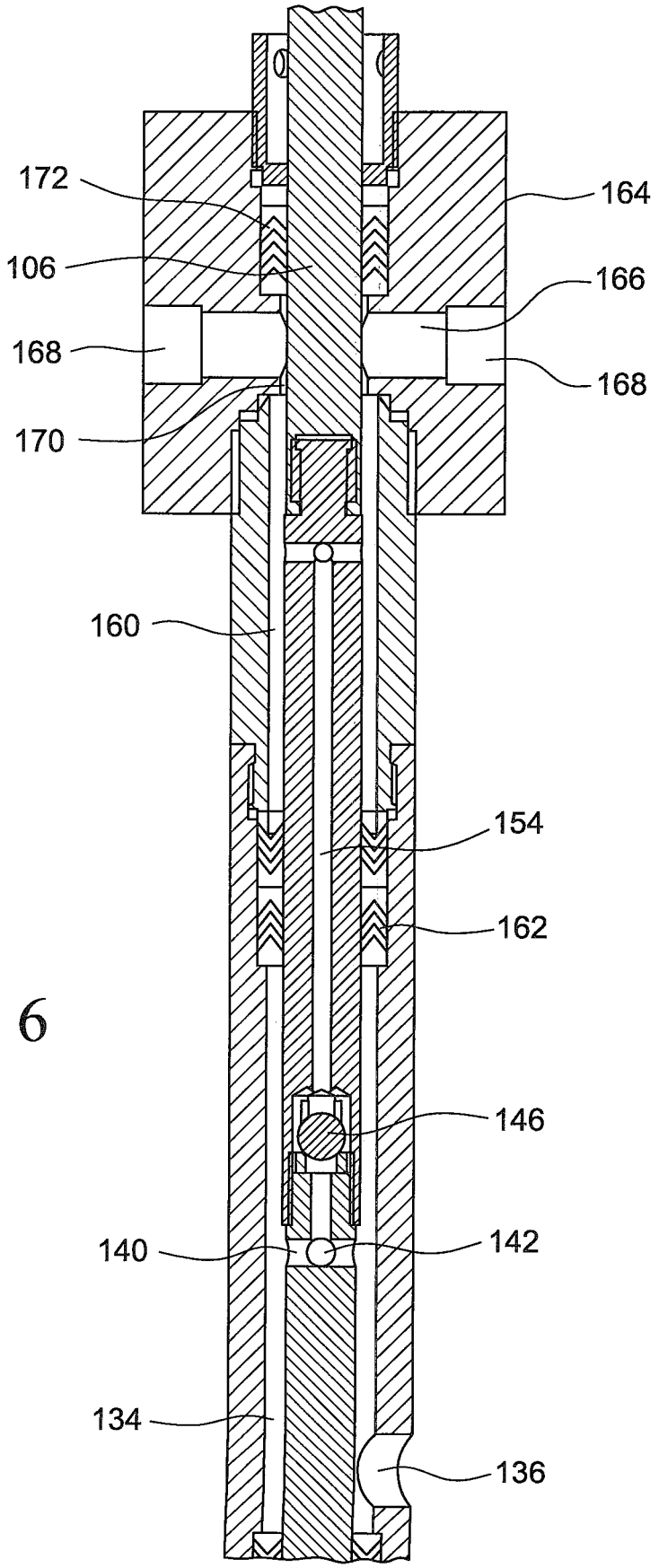
FIG. 6 is a schematic longitudinal schematic view of the central section of the pump piston rod assembly as disclosed within the pump assembly illustrated with FIG. 1 and illustrating an additional view so as to clearly illustrate the disposition of the fluid internally within the pump assembly.

Continuing further, and effectively in reverse, as the pump piston rod assembly 104, comprising the three pump piston rods 106,108,110, is moved downwardly from the raised or UP position, as disclosed within FIG. 4, to the lowered or DOWN position, as disclosed within FIG. 5, and remembering that the external diameter or external diametrical extent of the second intermediate pump piston 108 is 0.525 inches (0.525 in) and has a surface area of 0.2166 square inches (0.2166 $in^2$), while the external diameter or external diametrical extent of the third lowermost pump section 110 is 0.474 inches (0.474 in) and has a surface area of 0.1762 square inches (0.1762 $in^2$), the downward movement of the pump piston rod assembly 104 causes fluid, disposed within the first annular chamber 134 from the previous operational cycle, and now under relatively high pressure due to the downward movement of the pump piston rod assembly 104, to move through the first annular chamber 134, the first set of orthogonally oriented through-bores or cross passageways 140,142, and the vertically oriented fluid passageway 144 so as to unseat the ball check valve 146 from its lower valve seat 150 such that the ball check valve is now engaged with the upper ball stop 148. Accordingly, the fluid bypassing the ball check valve 146 passes through the multiple fluid passageways 152 and enters the central or axial fluid passageway 154 defined within the intermediate pump piston rod section 108. At the same time, the relatively high pressure generated within the various fluid passageways as well as within the first annular chamber 134, which is fluidically connected to the valve assembly 130, causes the first lower check valve 132 to be seated whereby the fluid inlet is now closed.

Continuing further, the fluid can then enter the second set of orthogonally oriented through-bores or cross passageways 156,158 and enter the second annular chamber 160 such that an output deposit of 0.0404 square inches (0.0404 $in^2$), which is derived by subtracting the surface area of 0.1762 square inches (0.1762 $in^2$) of the third lowermost pump section 110 from the surface area of 0.2166 square inches (0.2166 $in^2$) characteristic of the second intermediate pump section 108, is caused to flow upwardly through the second annular chamber 160, through the axial extension 170 of the second annular chamber 160 which is defined within the fluid outlet junction box 164, and is caused to flow outwardly toward a particular one of the fluid outlets 168. It is to be appreciated, however, that since the pump piston rod assembly 104 is moving downwardly, the second intermediate pump piston rod section 108 will begin to move downwardly through the second upper annular chamber 160 as will the first uppermost pump piston rod section 106. Since the first uppermost pump piston rod section 106 only has an external diameter or external diametrical extent of 0.500 inches (0.500 in), and a surface area of 0.1964 square inches (0.1964 $in^2$), while the external diameter or external diametrical extent of the second intermediate pump piston rod section 108 has an external diameter or external diametrical extent of 0.525 inches (0.525 in), and a surface area of 0.2166 square inches (0.2166 $in^2$), then as the two pump piston rod sections 108,106 pass through the second upper annular chamber 160 during the noted down stroke of the pump piston rod assembly 104, an annular void is effectively created within the second upper annular chamber 160 of 0.0202 square inches (0.0202 $in^2$) which is the difference between the surface area of 0.2166 square inches (0.2166 $in^2$) characteristic of the second intermediate piston pump section 108 and the surface area of 0.1964 square inches (0.1964 $in^2$) characteristic of the first uppermost pump piston rod section 106. The pumped fluid will of course tend to fill this void. Therefore, in order to effectively compensate for this fluid filling the aforenoted void, or, in other words, in order to compensate for this "loss" of fluid as the fluid is being pumped through the pump assembly 100, the fluid being pumped through the pump assembly 100 during the downstroke of the pump piston rod assembly 104 must effectively be twice the amount of fluid being pumped during the upstroke of the pump piston rod assembly 104 such that the real pump output during the downstroke of the pump piston rod assembly 104 will be 0.0404 square inches (0.0404 $in^2$), minus 0.0202 square inches (0.0202 $in^2$), that is, the amount of fluid filling the aforenoted void, or 0.0202 square inches (0.0202 $in^2$), or 0.0202 square inches (0.0202 $in^2$), which is identical to the pump output during the upstroke of the pump piston rod assembly 104.

Figure 7:
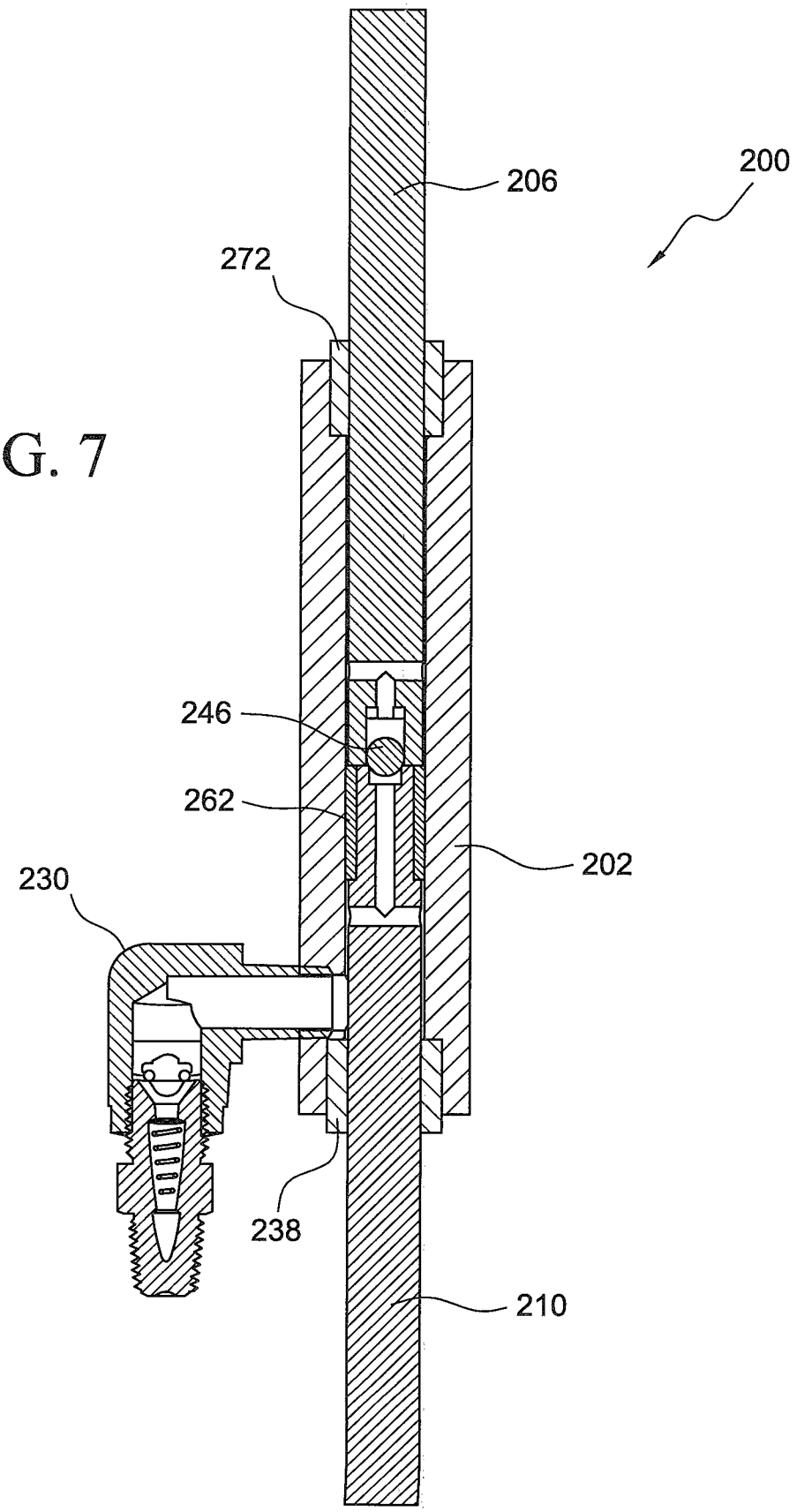
FIG. 7 is a longitudinal cross-sectional view, similar to that of FIG. 1, showing, however, a second embodiment of a new and improved positive displacement reciprocating pump assembly as constructed in accordance with the principles and teachings of the present invention wherein in lieu of the use of three pump piston rod sections, only two pump piston rod sections are utilized, and where all of the rod seals or packings were fixed with respect to the three pump piston rod sections as disclosed in connection with the first embodiment of the positive displacement reciprocating pump assembly as disclosed within FIG. 1, the intermediate or central rod seal or packing material of the second embodiment pump piston assembly is effectively fixed upon the upper end portion of the lower piston rod section so as to comprise a movable rod seal or packing material which moves axially along with the upper end portion of the lower piston rod section.
Figure 8:
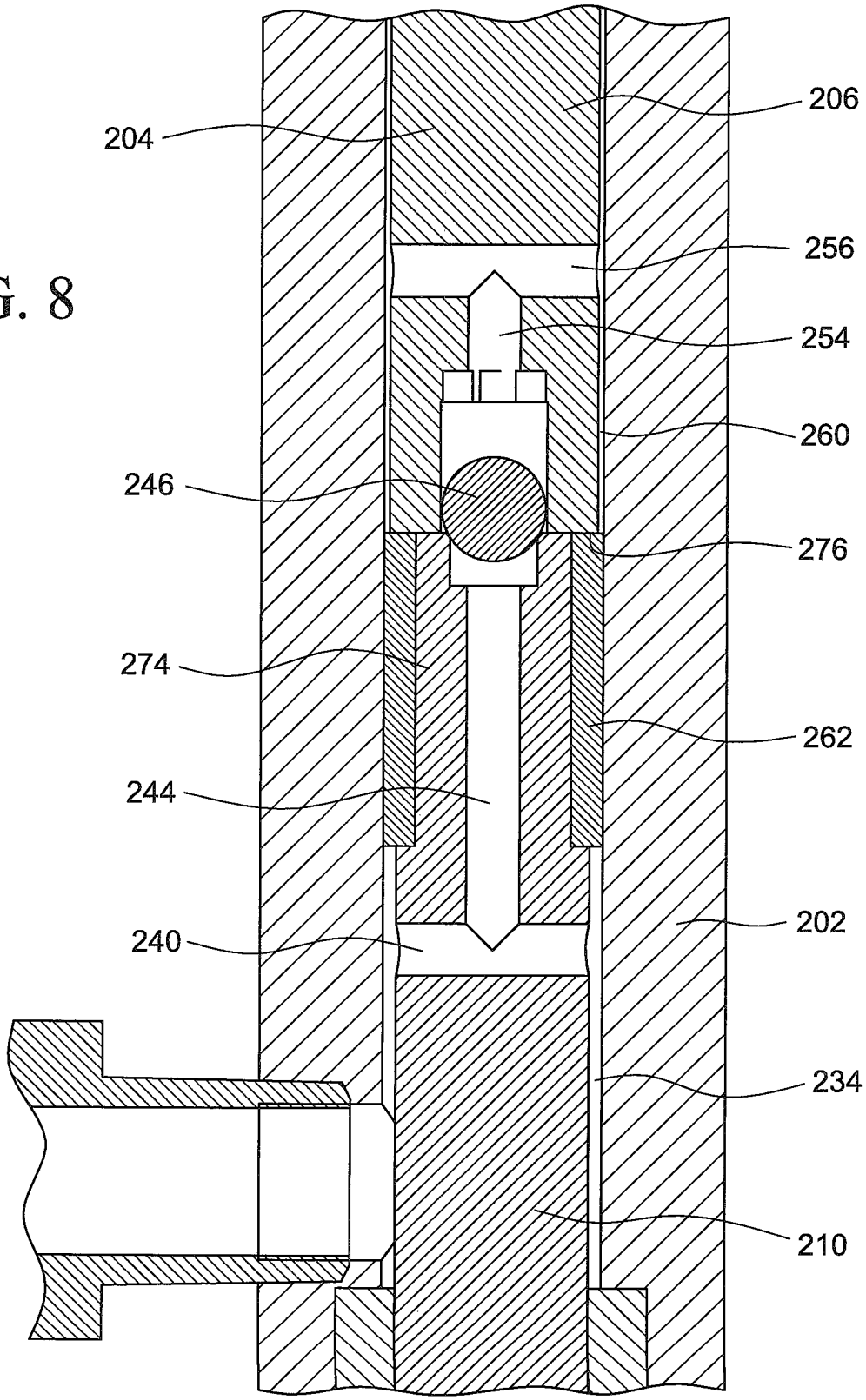
FIG. 8 is an enlarged view of the upper end portion of the lower pump piston rod section having the intermediate or central rod seal or packing material fixedly mounted thereon.

With reference now being made to FIGS. 7 and 8, there is disclosed a second embodiment of a positive displacement reciprocating pump assembly as constructed in accordance with the principles and teachings of the present invention. The second embodiment of the positive displacement reciprocating pump assembly of the present invention is seen to be generally indicated by the reference character 200, and it is to be noted that component parts of the second embodiment positive displacement reciprocating pump assembly 200 which correspond to component parts of the first embodiment of the positive displacement reciprocating pump assembly 100 will be designated by corresponding reference numbers except that they will be within the 200 series. In addition, a detailed description of the structure and operation of the second embodiment of the positive displacement reciprocating pump assembly 200 of the present invention will not be provided in view of the fact that the overall operation of the two embodiments are the same, however, a detailed description of the structural differences comprising the second embodiment of the positive displacement reciprocating pump assembly 200, and its operation, as compared to the aforenoted described structure comprising the first embodiment of the positive displacement reciprocating pump assembly 100, will in fact be provided. Therefore, with reference in fact being made to FIGS. 7 and 8, it is seen, for example, that two major structural differences between the first and second embodiments of the positive displacement reciprocating pump assemblies 100,200 reside in the fact that within the second embodiment of the positive displacement reciprocating pump assembly 200, only two piston rod sections 206,210 are provided as upper and lower pump piston rod sections, and that the intermediate annular rod seals or packing material 262 are not only axially movable along with the upper and lower pump piston rod sections 206,210, but as can clearly be seen from FIG. 8, the intermediate annular rod seals or packing material 262 is fixedly interposed between the an upper end portion 274 and the lower end face 276 of the upper pump piston rod section 210.

It is additionally noted, in a manner similar to that of the first embodiment of the pump piston assembly 100, that the external diameter or diametrical extent of the first upper pump piston rod section 206 is 0.500 inches (0.500 in), with a surface area of 0.1964 square inches (0.1964 $in^2$), while the the external diameter or diametrical extent of the second lower pump piston rod section 210 is 0.474 inches (0.474 in), with a surface area of 0.1762 square inches (0.1762 $in^2$), while, still further, the external diameter or diametrical extent of the fixed annular rod seals or packing material 262 is 0.525 inches (0.525 in), with a surface area of 0.2166 square inches (0.2166 $in^2$). Accordingly, the pump piston rod assembly 204 effectively defines three different diametrical regions or sections similar to those of the pump piston rod assembly 104 of the first embodiment positive displacement pump assembly 100, but only comprises two pump piston rod sections 206, 210, with the third "rod section" effectively being defined by means of the intermediate rod seals or packing material 262 which moves axially along the internal peripheral bore of the pump piston housing 202 while the pump piston rod assembly 204 moves between its UP and DOWN positions, so as to still provide the aforenoted pump outputs of 0.0202 square inches (0.0202 $in^2$) during both the UP and DOWN strokes. It is to be lastly noted that in view of the axial movement of the intermediate rod seals or packing material 262 along the internal peripheral bore of the pump piston housing 202 while the pump piston rod assembly 204 moves between its UP and DOWN positions, the internal peripheral bore of the housing 202 must have a diametrical extent of 0.525 inches (0.525 in).

Obviously, many variations and modifications of the present invention are possible in light of the above teachings. For example, while the aforenoted description has effectively disclosed a positive displacement pump assembly for dispensing purposes, the pump assembly can likewise be utilized for spraying operations. In addition, while the fluid outputs have been noted as being 0.0202 square inches (0.0202 $in^2$), other fluid outputs are of course achievable utilizing differently sized pump piston sections. It is therefore to be understood that within the scope of the appended claims, the present invention may be practiced otherwise than as specifically described herein.

REFERENCE NUMBER KEY

100—First embodiment of reciprocating pump assembly
102—Pump piston rod housing
104—Pump piston rod assembly
106—First uppermost pump piston rod section of pump piston rod assembly
108—Second intermediate pump piston rod section
110—Third lowermost pump piston rod section of pump piston rod assembly
112—Connection between first upper and second intermediate rod sections
114—Connection between second and third piston rod sections
116—Hydraulic drive motor assembly for pump piston rod assembly
118—Housing of hydraulic drive motor assembly 116
120—Actuator piston of hydraulic drive motor assembly 116
121—Actuator piston head of hydraulic drive motor assembly 116
122—Lower end portion of actuator piston 120
124—Upper end portion of first uppermost pump piston rod section 106
126—Input/output connector for hydraulic drive motor assembly 116
128—Input/output connector for hydraulic drive motor assembly 116
130—Fluid intake valve assembly
132—First lower check valve
134—First annular chamber
136—Fluid conduit connecting valve assembly 130 to annular chamber 134
138—First lower set of annular rod seals or packing material
140/142—First pair of orthogonally oriented through-bores
144—Vertically oriented fluid conduit defined within lowermost rod section
146—Second check valve 146
148—Upper ball stop
150—Lower valve seat
152—Multiple fluid passageways around ball check valve 146
154—Vertical passageway defined within intermediate piston rod section

156/158—Second set of orthogonally oriented through-bores
160—Second annular chamber
162—Second intermediate set of rod seals or packing material
164—Fluid outlet junction box
166—Horizontally extending through-bore of junction box 164
168—Fluid outlets of fluid outlet junction box 164
170—Axial extension flowpath from second annular chamber 160
172—Third set of upper annular rod seals or packing material
200—Second embodiment of reciprocating pump assembly
202—Housing of pump assembly 200
204—Pump piston rod assembly
206—First upper piston rod of pump piston rod assembly 204
210—Second lower piston rod of pump piston rod assembly 204
230—Fluid inlet
234—First lower annular chamber
238—Lower rod seals or packing material
240—Cross bore within upper end of second lower piston rod 210
244—Vertical fluid passageway within upper end portion of lower rod
246—Ball check valve
254—Vertical passageway within first upper piston rod 206
256—Cross bore within first upper piston rod 206
260—Second upper annular chamber
262—Intermediate rod seals or packing material
272—Upper rod seals or packing material
274—Upper end portion of second lower piston rod 210
276—Lower end face of first upper piston rod 206

What is claimed as new and desired to be protected by Letters Patent, is:

1. A positive displacement reciprocating pump assembly, comprising:

a pump housing;

a piston rod assembly disposed within said pump housing;

a fluid inlet for inputting fluid into said pump housing; and a fluid outlet for outputting fluid out from said housing, wherein said piston rod assembly comprises three different sections having three different diametrical extents and three different effective surface areas wherein the difference between the effective surface area defined between a first one of said three different sections of said piston rod assembly and a second one of said three different sections of said piston rod assembly is twice the difference between the effective surface area defined between said first one of said three different sections of said piston rod assembly and a third one of said three different sections of said piston rod assembly such that the volumetric fluid outputs from said reciprocating pump assembly are the same during both the UP and DOWN strokes of the pump piston rod assembly.

2. The pump assembly as set forth in claim 1, wherein:

said three different sections of said pump piston rod assembly having said three different diametrical extents and three different effective surface areas comprise three different pump piston rod sections fixedly connected together.

3. The pump assembly as set forth in claim 2, wherein:

said three different pump piston rod sections comprise a first uppermost pump piston rod section having a first predetermined external diametrical extent and a first predetermined effective surface area, a second intermediate pump piston rod section having a second predetermined external diametrical extent and a second predetermined effective surface area, and a third lowermost pump piston rod section having a third predetermined external diametrical extent and a third predetermined effective surface area.

4. The reciprocating pump assembly as set forth in claim 3, wherein:

said second predetermined external diametrical extent and said second predetermined effective surface area of said second intermediate pump piston rod section is greater than said first predetermined external diametrical extent and said first predetermined effective surface area of said first uppermost pump piston rod section, and is also greater than said third predetermined external diametrical extent and said third predetermined effective surface area of said third lowermost pump piston rod section.

5. The reciprocating pump assembly as set forth in claim 4, wherein:

said first predetermined external diametrical extent and said first predetermined effective surface area of said first uppermost pump piston rod section is greater than said third predetermined external diametrical extent and said third predetermined effective surface area of said third lowermost pump piston rod section.

6. The reciprocating pump assembly as set forth in claim 5, wherein:

when said pump piston rod assembly is being moved in the UP stroke direction toward its UP position, said difference defined between said external diametrical extent and said effective surface area of said second intermediate pump piston rod section, as compared to said external diametrical extent and said effective surface area of said first uppermost pump piston rod section, results in a predetermined fluid flow and output from said reciprocating pump assembly.

7. The reciprocating pump assembly as set forth in claim 6, wherein;

when said pump piston rod assembly is being moved in the DOWN stroke direction toward its DOWN position, said difference defined between said external diametrical extent and said effective surface area of said second intermediate pump piston rod section, as compared to said external diametrical extent and said effective surface area of said third lowermost pump piston rod section, results in a fluid flow through said pump assembly which is twice said fluid flow through said pump assembly when said pump piston rod assembly is being moved in the UP stroke direction toward its UP position, however, due to fluid losses within said pump assembly during movement of said pump piston rod assembly through said DOWN stroke, output flow of fluid from said reciprocating pump assembly is equal to said predetermined fluid output attained from said pump assembly when said pump piston rod assembly is being moved during said UP stroke toward said UP position.

8. The pump assembly as set forth in claim 1, further comprising:

a rod seal/packing material section fixedly mounted within said pump housing such that said three different sections of said pump piston rod assembly move relative to said rod seal/packing material section when said pump piston rod assembly moves through said UP and DOWN strokes.

9. The pump assembly as set forth in claim 8, wherein:

said three different sections of said pump piston rod assembly comprise a first upper pump piston rod section having a first predetermined external diametrical extent and a first predetermined effective surface area, a second intermediate pump piston rod section having a second predetermined external diametrical extent and a second predetermined effective surface area, and a third lower pump piston rod section having a third predetermined external diametrical extent and a third predetermined effective surface area.

10. The reciprocating pump assembly as set forth in claim 9, wherein:

said second predetermined external diametrical extent and said second predetermined effective surface area of said second intermediate pump piston rod section is greater than said first predetermined external diametrical extent and said first predetermined effective surface area of said first upper pump piston rod section, and is also greater than said third predetermined external diametrical extent and said third predetermined effective surface area of said third lower pump piston rod section.

11. The reciprocating pump assembly as set forth in claim 10, wherein:

said first predetermined external diametrical extent and said first predetermined effective surface area of said first upper pump piston rod section is greater than said third predetermined external diametrical extent and said third predetermined effective surface area of said third lower pump piston rod section.

12. The reciprocating pump assembly as set forth in claim 11, wherein:

when said pump piston rod assembly is being moved in the UP stroke direction toward its UP position, said difference defined between said external diametrical extent and said effective surface area of said second intermediate pump piston rod section, as compared to said external diametrical extent and said effective surface area of said first upper pump piston rod section, results in a predetermined fluid flow through and output from said reciprocating pump assembly.

13. The reciprocating pump assembly as set forth in claim 12, wherein:

when said pump piston rod assembly is being moved in the DOWN stroke direction toward its DOWN position, said difference defined between said external diametrical extent and said effective surface area of said second intermediate pump piston rod section, as compared to said external diametrical extent and said effective surface area of said third lower pump piston rod section, results in a fluid flow through said pump assembly which is twice said fluid flow through said pump assembly when said pump piston rod assembly is being moved in the UP stroke direction toward its UP position, however, due to fluid losses within said pump assembly during movement of said pump piston rod assembly through said DOWN stroke, output flow of fluid from said reciprocating pump assembly is equal to said predetermined fluid output attained from said pump assembly when said pump piston rod assembly is being moved during said UP stroke toward said UP position.

* * * * *